US011844160B2

(12) United States Patent
Zeng et al.

(10) Patent No.: US 11,844,160 B2
(45) Date of Patent: Dec. 12, 2023

(54) MONOLITHIC BUS SLAVE CIRCUIT STRUCTURE

(71) Applicant: CRM ICBG (WUXI) CO., LTD., Jiangsu (CN)

(72) Inventors: Jieqiong Zeng, Jiangsu (CN); Tianshun Zhang, Jiangsu (CN); Jun Zhang, Jiangsu (CN); Zengwei Ding, Jiangsu (CN); Junlei Wu, Jiangsu (CN); Yufang Liu, Jiangsu (CN); Lili Jiang, Jiangsu (CN)

(73) Assignee: CRM ICBG (WUXI) CO., LTD., Jiangsu (CN)

( * ) Notice: Subject to any disclaimer, the term of this patent is extended or adjusted under 35 U.S.C. 154(b) by 0 days.

(21) Appl. No.: 18/033,201

(22) PCT Filed: Jul. 2, 2021

(86) PCT No.: PCT/CN2021/104278
§ 371 (c)(1),
(2) Date: Apr. 21, 2023

(87) PCT Pub. No.: WO2022/105248
PCT Pub. Date: May 27, 2022

(65) Prior Publication Data

US 2023/0292419 A1 Sep. 14, 2023

(30) Foreign Application Priority Data

Nov. 20, 2020 (CN) ..... 202011307397.0

(51) Int. Cl.
*H05B 45/375* (2020.01)
*H05B 47/155* (2020.01)
*H05B 45/48* (2020.01)

(52) U.S. Cl.
CPC ..... *H05B 45/375* (2020.01); *H05B 45/48* (2020.01); *H05B 47/155* (2020.01)

(58) Field of Classification Search
CPC ..... H05B 45/375; H05B 45/48; H05B 47/155
See application file for complete search history.

(56) References Cited

U.S. PATENT DOCUMENTS

2007/0188427 A1* 8/2007 Lys ..... H05B 45/46 345/82
2016/0095176 A1* 3/2016 Chang Hu ..... H05B 45/385 315/205
2020/0060010 A1 2/2020 Hsia

FOREIGN PATENT DOCUMENTS

CN 201764452 U 3/2011
CN 110602S34 12/2019

(Continued)

*Primary Examiner* — Daniel D Chang
(74) *Attorney, Agent, or Firm* — Global IP Services; Tianhua Gu

(57) ABSTRACT

A monolithic bus slave circuit structure is provided, including: a monolithic integrated chip, a rectifier bridge, a first light circuit, a second light circuit, and a third light circuit. The monolithic integrated chip includes a bus voltage input pin, a ground pin, a first drive signal output pin, a second drive signal output pin, a third drive signal output pin, and a power output pin. Both the bus voltage input pin and the ground pin are connected to an output end of the rectifier bridge, two input ends of the rectifier bridge are connected to a positive line and an negative line of a bus respectively, the ground pin is grounded. The monolithic bus slave circuit structure realizes the intelligent constant current drive function and drive the light circuits with constant current in the voltage range of the whole bus, which does not depend on the parameters of the LEDs.

11 Claims, 7 Drawing Sheets

(56) References Cited

FOREIGN PATENT DOCUMENTS

| | | | |
|---|---|---|---|
| CN | 112351565 | A | 2/2021 |
| CN | 213244437 | U | 5/2021 |
| JP | 2008166165 | A | 7/2008 |
| KR | 20090092994 | A | 9/2009 |
| KR | 20140102047 | A | 8/2014 |

* cited by examiner

MONOLITHIC BUS SLAVE CIRCUIT STRUCTURE

CROSS REFERENCE TO RELATED PATENT APPLICATION

The present application is the US national stage of PCT/CN2021/104278 filed on 2021 Jul. 2, which claims the priority of the Chinese patent application No. 202011307397.0 filed on 2020 Nov. 20, which application is incorporated herein by reference.

Technical Field

The present disclosure relates to the field of bus networking, and in particular, to the field of emergency evacuation lights, more specifically, to a monolithic bus slave circuit structure.

BACKGROUND

A bus networked emergency evacuation light slave circuit is implemented in FIG. 1. Where Lp is a positive line of a bus, and Ln is a negative line of the bus. Multiple emergency evacuation light systems are usually hooked up to the bus of a host to act as slaves, and the maximum number of the slaves is 64. Each slave system is unified, and the host can perform address coding on each slave through bus communication, so as to achieve one-to-one correspondence. An emergency evacuation light includes three groups of light-emitting diodes (LEDs), and three groups of LEDs can light up the left arrow, the right arrow, and the middle human figure respectively.

Usually, a bus voltage VBUS of a slave closest to the host end is 36 V, a voltage VCC output from a DC/DC voltage conversion integrated chip is 12 V, and a voltage VDD output from a low dropout regulator (LDO) integrated chip is 5 V or 3 V. The slaves are distributed in various locations in a building, the length of the bus is long (about 500 meters), and a line resistor of the bus cannot be ignored. After the current of each slave flows through the line resistor, a large voltage drop will occur and the bus voltage VBUS of the slave (such as, a slave 64) hooked up to the end of the bus will be reduced to about 16 V. Therefore, for the DC/DC voltage conversion integrated chip, a stable voltage of 12 V should be generated when an input voltage signal varies from 16 V to 36 V, and the load capacity must be sufficient to light up each emergency evacuation light, which has high performance requirements for the DC/DC voltage conversion integrated chip. In the market, the DC/DC voltage conversion integrated chip is expensive and necessary. If there is no the DC/DC voltage conversion integrated chip, a voltage VH (about 36 V) in FIG. 1 is directly connected to the emergency evacuation light in FIG. 1 to act as a power source, which will lead to a great waste of electric power. In addition, the slave circuit needs to use multiple integrated chips, such as, the DC/DC voltage conversion integrated chips with high cost, the LDO integrated chips, and the MCU integrated chips. Meanwhile, a large number of discrete devices are required to build communication modules, which will lead to poor system reliability and weak anti-interference ability.

In addition, the bus networked emergency evacuation light slave circuit adopts a constant voltage drive light to achieve constant current. A current value $I_{LED}$ flowing through the emergency evacuation light depends on a voltage drop of each emergency evacuation light and a resistance value of a resistor R4, it can be expressed as $I_{LED}$=(VCC−VLED)/R4, where VCC is usually 12 V, VLED is the voltage drop of the three LEDs (one group of LEDs) and is usually about 10 V, and the current value $I_{LED}$ is usually about 10 mA, so the resistance value of the resistor R4 is about 2 KΩ. It can be seen that each current value $I_{LED}$ is related to the voltage drop of one group of LEDs. However, in actual production, there is a large difference in the voltage drop between the LEDs of the emergency evacuation light, which leads to a large deviation of each current $I_{LED}$, and the constant current characteristic of each group of LEDs depends on the parameter characteristics of the LEDs, which shows that the brightness of each LED is not uniform. The energy usage efficiency of the LED driving part can be expressed as $(VLED \times I_{LED})/(VCC \times I_{LED}) \approx 10/12 \approx 83.3\%$. It can be seen that about 16.7% of the energy is wasted on the resistor R4, and the usage efficiency of the energy is low.

Therefore, the present disclosure focuses on at least one of the above shortcomings and provides a technical solution, that is, a monolithic integrated solution is adopted to reduce the cost of an entire system, improve reliability and anti-interference ability, and ensure constant current driving characteristics of the LEDs and high energy usage efficiency.

SUMMARY

The present disclosure provides a monolithic bus slave circuit structure. The monolithic bus slave circuit structure includes: a monolithic integrated chip, a rectifier bridge, a first light circuit, a second light circuit, and a third light circuit. Where the monolithic integrated chip is provided with a bus voltage input pin, a ground pin, a first drive signal output pin, a second drive signal output pin, a third drive signal output pin, and a power output pin; both the bus voltage input pin and the ground pin are connected to an output end of the rectifier bridge, two input ends of the rectifier bridge are connected to a positive line and an negative line of a bus respectively, the ground pin is grounded; the first light circuit is connected between the first drive signal output pin and the power output pin, the second light circuit is connected between the second drive signal output pin and the power output pin, and the third light circuit is connected between the third drive signal output pin and the power output pin; the power output pin is connected to one end of an energy storage capacitor, and the other end of the energy storage capacitor is grounded.

In an embodiment, the first light circuit includes a first inductor, a first diode string and a first freewheeling diode, where the first inductor is connected between the first drive signal output pin and one end of the first diode string, the other end of the first diode string is connected to the power output pin, an anode of the first freewheeling diode is connected to the first drive signal output pin, a cathode of the first freewheeling diode is connected to the power output pin; the second light circuit includes a second inductor, a second diode string and a second freewheeling diode, where the second inductor is connected between the second drive signal output pin and one end of the second diode string, the other end of the second diode string is connected to the power output pin, an anode of the second freewheeling diode is connected to the second drive signal output pin, a cathode of the second freewheeling diode is connected to the power output pin; the third light circuit includes a third inductor, a third diode string and a third freewheeling diode, where the third inductor is connected between the third drive signal output pin and one end of the third diode string, the other end of the third diode string is connected to the power output pin, an anode of the third freewheeling diode is connected to the third drive signal output pin, a cathode of the third freewheeling diode is connected to the power output pin.

In an embodiment, the first diode string includes a first diode, a second diode, and a third diode connected in series, the second diode string comprises a fourth diode, a fifth diode, and a sixth diode connected in series, the third diode light string comprises a seventh diode, an eighth diode, and a ninth diode connected in series.

In an embodiment, the monolithic integrated chip includes: a power conversion module, connected to a central processing unit, a communication module, an analog-to-digital conversion module, a resistor divider module and a drive module, for generating internal power supply and providing power to the central processing unit, the communication module, the analog-to-digital conversion module, the resistor divider module and the drive module; the central processing unit, connected to the communication module, the analog-to-digital conversion module, the resistor divider module and the drive module, for controlling signal transmission between a host and slaves; the communication module, connected to the bus voltage input pin, for transmitting signals between the host and the slaves; the analog-to-digital conversion module, connected to the resistor divider module, for converting an analog signal to a digital signal; the resistor divider module, connected to the first drive signal output pin, the second drive signal output pin, and the third drive signal output pin, for obtaining resistance division voltage values; the drive module, connected to the first drive signal output pin, the second drive signal output pin, and the third drive signal output pin, for driving the first light circuit, the second light circuit, and the third light circuit.

In an embodiment, the communication module includes a switch control unit, a comparator threshold selection switch control unit and a comparator, the switch control unit is connected to a power supply voltage end and a bus voltage end respectively, the power supply voltage end is grounded through a plurality of resistors connected in series, nodes between the plurality of resistors are all connected to the comparator threshold selection switch control unit, and the comparator threshold selection switch control unit is also connected to an inverting input end of the comparator, a non-inverting input terminal of the comparator is connected to the bus voltage end through a resistor, and the non-inverting input end of the comparator is also grounded through a second resistor.

In an embodiment, the drive module includes an over-zero detection unit, a peak current detection unit and a reference unit; the first drive signal output pin, the second drive signal output pin and the third drive signal output pin are connected to an input end of the over-zero detection unit, an input end of the peak current detection unit is connected to an output end of the over-zero detection unit and an output end of the reference unit; the drive module includes a first field effect transistor, a second field effect transistor and a third field effect transistor, a drain of the first field effect transistor is connected to the first drive signal output pin, a drain of the second field effect transistor is connected to the second drive signal output pin, and a drain of the third field effect transistor is connected to the third drive signal output pin, gates of the first field effect transistor, the second field effect transistor and the third field effect transistor is connected to an output end of the peak current detection, sources of the first field effect transistor, the second field effect transistor and the third field effect transistor are grounded through resistors respectively, and are connected to the input end of the peak current detection.

In an embodiment, the communication module is connected to the central processing unit through a first line, a second line and a third line, where the first line is for outputting a decoded signal to realize the control and instruction operation of the host to the slaves; the second line is for sending signals to the host according to the situation of intelligent drive and intelligent fault detection; the third line is for outputting a control signal to the communication module, to intelligently adjust a comparison threshold point of a code receiving comparator of the communication module.

In an embodiment, the drive module is connected to the central processing unit through a fourth line and a fifth line, the central processing unit controls a constant current value of the drive module through the fourth line, and controls on and off of the drive module through the fifth line In an embodiment, the communication module transmits signals between the host and the slaves by sampling and decoding a voltage waveform of a bus voltage and extracting current from the bus voltage input pin In an embodiment, the resistance division voltage values are the voltage division values of the bus voltage input pin, the ground pin, the first drive signal output pin, the second drive signal output pin, the third drive signal output pin, and the power supply output pin In an embodiment, the monolithic integrated chip further includes a first extension pin and a second extension pin.

The monolithic bus slave circuit structure of the present disclosure can realize the intelligent constant current drive function, and drive the light circuits with the constant current in the voltage range of the whole bus, which does not depend on the parameters of the LEDs. The brightness of the LEDs is kept uniform, and the number of the LEDs can be flexibly adjusted. Finally, the high energy efficiency is ensured. The present disclosure can realize the intelligent fault detection function and the open and short circuit detection of each group of lights, and then the results are reported to the host through bus communication, and the host can locate and repair the fault in time according to the fault situation.

DETAILED DESCRIPTION OF THE PREFERRED EMBODIMENTS

Figure 1:
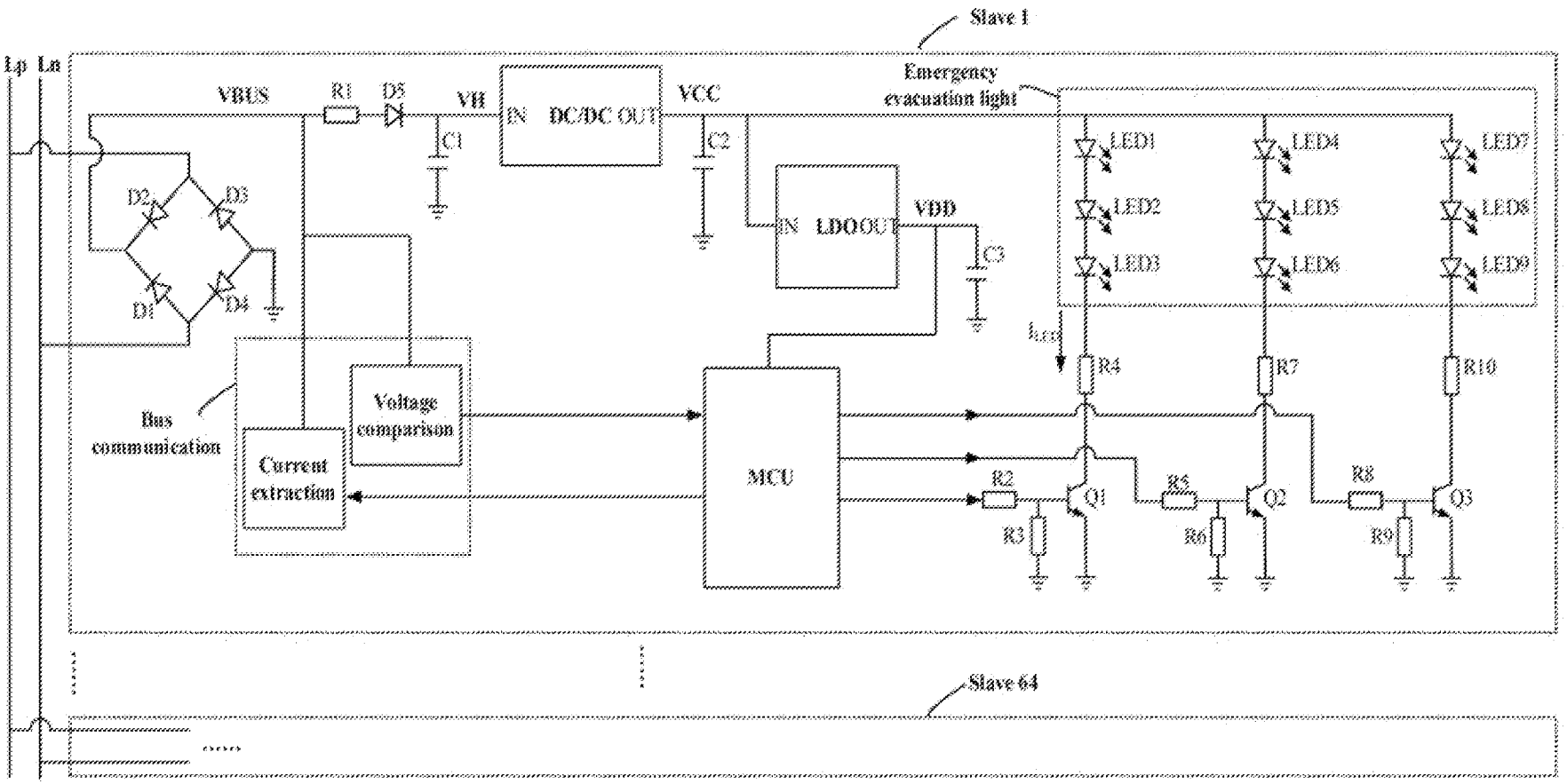
FIG. 1 is a schematic structural diagram of a bus networked emergency evacuation light slave circuit according to an embodiment of the present disclosure.

In order to clearly describe the technical content of the present disclosure, further description will be made below with reference to specific embodiments.

A monolithic bus slave circuit structure of the present disclosure includes a monolithic integrated chip, a rectifier bridge, a first light circuit, a second light circuit, and a third light circuit. The monolithic integrated chip includes a bus voltage input pin, a ground pin, a first drive signal output pin, a second drive signal output pin, a third drive signal output pin, and a power output pin.

Both the bus voltage input pin and the ground pin are connected to an output end of the rectifier bridge, two input ends of the rectifier bridge are connected to a positive line and an negative line of a bus respectively, the ground pin is grounded.

The first light circuit is connected between the first drive signal output pin and the power output pin, the second light circuit is connected between the second drive signal output pin and the power output pin, and the third light circuit is connected between the third drive signal output pin and the power output pin.

The power output pin is also connected to one end of an energy storage capacitor, and the other end of the energy storage capacitor is grounded.

In an embodiment, the first light circuit includes a first inductor, a first diode string and a first freewheeling diode. Where the first inductor is connected between the first drive signal output pin and one end of the first diode string, the other end of the first diode string is connected to the power output pin, an anode of the first freewheeling diode is connected to the first drive signal output pin, a cathode of the first freewheeling diode is connected to the power output pin.

The second light circuit includes a second inductor, a second diode string and a second freewheeling diode. Where the second inductor is connected between the second drive signal output pin and one end of the second diode string, the other end of the second diode string is connected to the power output pin, an anode of the second freewheeling diode is connected to the second drive signal output pin, a cathode of the second freewheeling diode is connected to the power output pin.

The third light circuit includes a third inductor, a third diode string and a third freewheeling diode. Where the third inductor is connected between the third drive signal output pin and one end of the third diode string, the other end of the third diode string is connected to the power output pin, an anode of the third freewheeling diode is connected to the third drive signal output pin, a cathode of the third freewheeling diode is connected to the power output pin.

In an embodiment, the first diode light string includes a first diode, a second diode, and a third diode connected in series, the second diode string includes a fourth diode, a fifth diode, and a sixth diode connected in series, the third diode string includes a seventh diode, an eighth diode, and a ninth diode connected in series.

In an embodiment, the monolithic integrated chip includes a power conversion module, a central processing unit, a communication module, an analog-to-digital conversion module, a resistor divider module and a drive module.

The power conversion module is connected to the central processing unit, the communication module, the analog-to-digital conversion module, the resistor divider module and the drive module, and is for generating internal power supply and providing power to the central processing unit, the communication module, the analog-to-digital conversion module, the resistor divider module and the drive module.

The central processing unit is connected to the communication module, the analog-to-digital conversion module, the resistor divider module and the drive module, and is for controlling signal transmission between a host and slaves.

The communication module is connected to the bus voltage input pin, and is for transmitting signals between the host and the slaves.

The analog-to-digital conversion module is connected to the resistor divider module, and is for converting an analog signal to a digital signal.

The resistor divider module is connected to the first drive signal output pin, the second drive signal output pin, and the third drive signal output pin, and is for obtaining resistance division voltage values.

The drive module is connected to the first drive signal output pin, the second drive signal output pin, and the third drive signal output pin, and is for driving the first light circuit, the second light circuit, and the third light circuit.

In an embodiment, the communication module includes a switch control unit, a comparator threshold selection switch control unit and a comparator. The switch control unit is connected to a power supply voltage end and a bus voltage end respectively. The power supply voltage end is grounded through multiple resistors connected in series. Nodes between the multiple resistors are all connected to the comparator threshold selection switch control unit, and the comparator threshold selection switch control unit is also connected to an inverting input end of the comparator, a non-inverting input end of the comparator is connected to the bus voltage end through a resistor, and the non-inverting input end of the comparator is also grounded through a second resistor.

In an embodiment, the drive module includes an over-zero detection unit, a peak current detection unit and a reference unit. The first drive signal output pin, the second drive signal output pin and the third drive signal output pin are connected to an input end of the over-zero detection unit, an input end of the peak current detection unit is connected to an output end of the over-zero detection unit and to an output end of the reference unit.

The drive module includes a first field effect transistor, a second field effect transistor and a third field effect transistor. A drain of the first field effect transistor is connected to the first drive signal output pin. A drain of the second field effect transistor is connected to the second drive signal output pin. A drain of the third field effect transistor is connected to the third drive signal output pin. Gates of the first field effect transistor, the second field effect transistor and the third field effect transistor are connected to an output end of the peak current detection unit. Sources of the first field effect transistor, the second field effect transistor and the third field effect transistor are grounded through resistors respectively, and are connected to an input end of the peak current detection.

In an embodiment, the communication module is connected to the central processing unit through a first line, a second line and a third line. Where the first line is for outputting a decoded signal to realize the control and instruction operation of the host to the slaves; the second line is for sending signals to the host according to the situation of intelligent drive and intelligent fault detection; the third line is for outputting a control signal to the communication module to intelligently adjust a comparison threshold point of a code receiving comparator of the communication module.

In an embodiment, the drive module is connected to the central processing unit through a fourth line and a fifth line, the central processing unit controls a constant current value of the drive module through the fourth line, and controls on and off of the drive module through the fifth line.

In an embodiment, the communication module transmits signals between the host and the slaves by sampling and decoding a voltage waveform of a bus voltage and extracting current from the bus voltage input pin.

In an embodiment, the resistance division voltage values are resistance values of the bus voltage input pin, the ground pin, the first drive signal output pin, the second drive signal output pin, the third drive signal output pin, and the power supply output pin.

In an embodiment, the monolithic integrated chip includes a first extension pin and a second extension pin.

In the specific embodiment of the present disclosure, in the bus networking technology, the host can control a certain number of slave circuits according to the scale, and all the slaves are connected to the bus in parallel through two cables. The slaves obtain the power supply through the bus, and the bus is also used as a signal line for the communication between the host and the slaves. All the slave devices do not need to be equipped with batteries and do not need to be connected to the power supply separately through the bus networking technology. Therefore, the installation and maintenance costs are low, and the environment is environmentally friendly and pollution-free. More importantly, through the bus networking technology, all the slave circuits can be managed and deployed in a unified manner, which allows each independent slave circuit to be interrelated and linkage operation. For example, in the field of fire protection and security, intelligent evacuation and intelligent lighting are realized through the bus networking technology, and the sensing slave circuits of the whole building can be unifiedly controlled and networked by communication. When a fire or emergency occurs, the total emergency evacuation system calculates the best evacuation route based on the signals (including smoke, temperature, humidity, and the like) detected at each location and sends a command of the total emergency evacuation system to each emergency evacuation light, to make each emergency evacuation light receive the command, obtain the evacuation indication status, and control a corresponding indicator light and a voice module. Finally, the effective indication of the evacuation direction is realized.

In the prior art, the bus networked emergency evacuation light slave circuit requires multiple complex integrated chips and a large number of discrete devices, which has high cost, poor reliability and low energy use efficiency.

The present disclosure provides the monolithic bus slave circuit structure. The monolithic bus slave circuit structure can eliminate the complex design of using the DC/DC voltage conversion integrated chip in the prior art, and realizes the functions of intelligent constant current drive, intelligent bus communication, and intelligent fault detection at the same time. In addition, the present disclosure can adopt the cheapest SOP8 package to realize the emergency evacuation light slave circuit, and also adopt SOP14, SOP16, and SOP20 packages to realize the technical solution of the monolithic integrated chip according to the demand for extended functions and the number of drive lights, which simplifies the peripheral circuitry of the system, greatly reduces the cost of the system and improves the reliability and anti-interference ability of the system.

Figure 2:
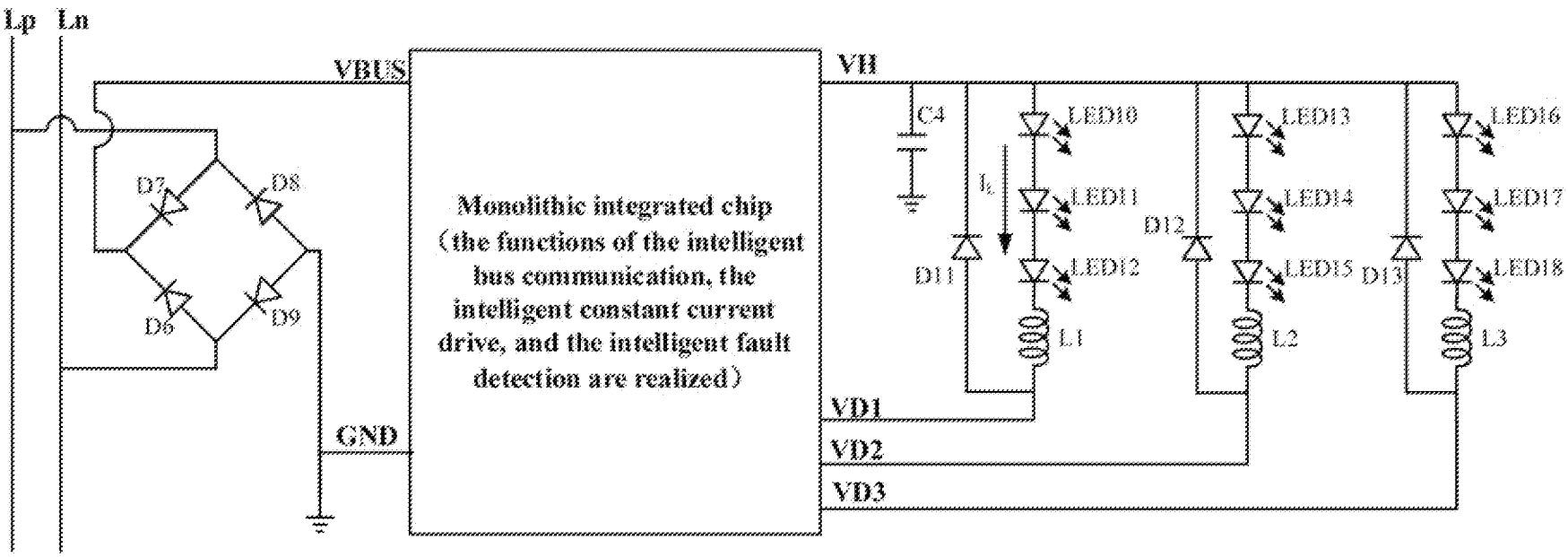
FIG. 2 is a schematic structural diagram of a monolithic bus slave circuit structure according to an embodiment of the present disclosure.

In an embodiment, the monolithic bus slave circuit adopts a monolithic integrated chip to realize the functions of intelligent bus communication, intelligent constant current drive and intelligent fault detection. The structure of the monolithic bus slave circuit is shown in FIG. 2. Taking driving three light circuits as an example, the monolithic integrated chip includes six pins, which are the bus voltage input pin, the power output pin, the ground pin, the first drive signal output pin, the second drive signal output pin, and the third drive signal output pin. The connection relationship is shown in FIG. 2, Lp is the positive line of the bus, and Ln is the negative line of the bus. The bus voltage VBUS is generated through the rectifier bridge including a diode D6, a diode D7, a diode D8, and a diode D9, and the bus voltage VBUS is connected to the monolithic integrated chip to act as a bus input. The power output pin of the monolithic integrated chip is connected to an energy storage capacitor C4, and the voltage VH is used as the power supply for driving the lights. The first drive signal output pin of the monolithic integrated chip is connected to one end of the first inductor L1 and the anode of the first freewheeling diode D11. The second drive signal output pin of the monolithic integrated chip is connected to one end of the second inductor L2 and the anode of the second freewheeling diode D12. The third drive signal output pin of the monolithic integrated chip is connected to one end of the third inductor L3 and the anode of the third freewheeling diode D13. The connection relationship of the three light circuits is as follows: the anode of the first diode LED10 in the first light circuit is connected to the voltage VH, the first diode LED10, the second diode LED11 and the third diode LED12 are connected in series in sequence, and the cathode of the third diode LED12 is connected to one end of the first inductor L1. The anode of the fourth diode LED13 in the second light circuit is connected to the voltage VH, the fourth diode LED13, the fifth diode LED14, and the sixth diode LED15 are connected in series in sequence, and the cathode of the sixth diode LED15 is connected to one end of the second inductor L2. The anode of the seventh diode LED16 in the third light circuit is connected to the voltage VH, the seventh diode LED16, the eighth diode LED17, and the ninth diode LED18 are connected in series in sequence, and the cathode of the ninth diode LED18 is connected to one end of the third inductor L3.

In an embodiment, the VBUS end is the bus voltage input pin, the GND end is the ground pin, the VD1 end is the first drive signal output pin, the VD2 end is the second drive signal output pin, the VD3 end is the third drive signal output pin, the VH end is the power output pin.

Figure 3:
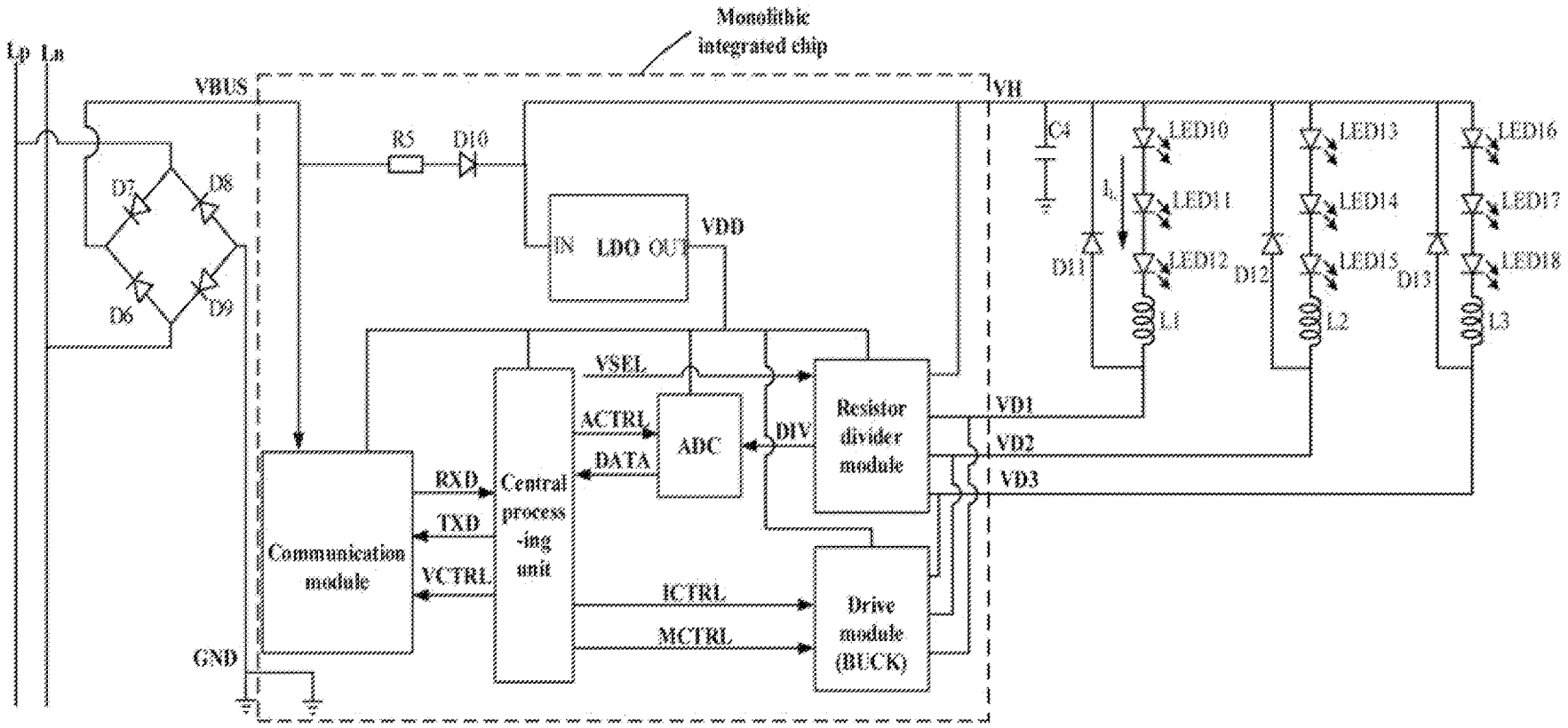
FIG. 3 is a schematic circuit diagram of a monolithic integrated chip of a monolithic bus slave circuit structure according to an embodiment of the present disclosure.

In an embodiment, the monolithic integrated chip includes the power conversion module, the communication module, the drive module, the central processing unit, the resistor divider module, the analog-to-digital conversion module, as shown in FIG. 3.

In an embodiment, the positive line and the negative line of the bus generate the bus voltage VBUS through the rectifier bridge including a diode D6, a diode D7, a diode D8, and a diode D9. The bus voltage VBUS generates the voltage VH through a current-limiting resistor R5, a diode D10 for preventing reverse bias, and a storage capacitor C4. When the bus is used to the function of communication, the voltage VH is maintained through the energy storage capacitor C4, thereby supplying power to the slaves. Meanwhile, the bus voltage VBUS is also connected to the communication module, and the communication module samples and decodes the voltage waveform of the bus voltage VBUS to realize the function of receiving signals from the host. Meanwhile, the communication module extracts a certain current from the bus voltage VBUS to realize the function of sending signals from the slaves to the host.

In an embodiment, the voltage VH generates an internal power supply VDD (usually 5 V or 3 V) through an internal power conversion module, and the internal power supply VDD is used as the power supply for other modules of the monolithic integrated chip, and is connected to the communication module, the central processing unit, the analog-to-digital conversion module, the resistor divider module, and the drive module.

Three interconnecting lines are disposed between the central processing unit and the communication module, and the three interconnecting lines are a line RXD, a line TXD, and a line VCTRL. A signal transmitted by the line RXD is a decoded signal output by the communication module, and the signal transmitted by the line RXD is transmitted to the central processing unit, which can realize the control and instruction operations of the host to the slaves. The signal transmitted by the line TXD is the signal sent by the slave circuits to the host according to the situation of the intelligent drive and the intelligent fault detection. The signal transmitted by the line VCTRL is the control signal sent from the central processing unit to the communication module, which can realize the intelligent adjustment of a comparison threshold point of the code receiving comparator of the communication module.

The central processing unit and the analog-to-digital conversion module are connected to each other. The central processing unit outputs the control signal ACRTL to control the time-division multiplexing sampling control and reading functions of ADC values of the analog-to-digital conversion module. The analog-to-digital conversion module sends the values converted by the analog-to-digital conversion module to the central processing unit through a signal DATA.

Two interconnecting lines are disposed between the central processing unit and the drive module, and the two interconnecting lines are a line ICTRL and a line MCTRL. The central processing unit controls the constant current value of the drive module through the line ICTRL, and controls on and off of each BUCK driver through the line MCTRL to intelligently drive the emergency evacuation light.

The drive module is also connected to the first drive signal output pin, the second drive signal output pin and the third drive signal output pin, to realize the intelligent constant current driving function of the three light circuits.

The central processing unit is interconnected with the resistor divider module, and the resistor divider module is also connected with the first drive signal output pin, the second drive signal output pin, the third drive signal output pin, and the power output pin. The central processing unit outputs the resistance division voltage value of each pin in time division to the signal DIV through the signal VSEL. The signal DIV is connected to the analog-to-digital conversion module, to detect the voltage of each outer pin, thereby realizing the functions of the intelligent fault detection and the open and short circuit detection for each light circuit. The central processing unit reports the results to the host through bus communication, and the host can locate and repair the fault in time according to the fault situation.

The circuit structure of the present disclosure can realize intelligent bus communication function, which can cover a wide voltage range of the bus. For the slave circuits hooked up to different positions on the bus, the comparison threshold point of the code receiving comparator can be adjusted intelligently, so that the number of the slaves hooked up to the bus can be increased. This reduces the total installation cost of the whole building and improves the reliability and anti-interference of the system. The specific implementation principle is as follows: the voltage division value of the voltage VH is obtained through the resistor divider module, and then the corresponding AD value is obtained through the analog-to-digital conversion module. The CPU module obtains the voltage of the bus corresponding to the current slave through the detected AD value, and then the communication module is controlled by the signal VCTRL according to the voltage waveform diagram during host communication and the appropriate comparison threshold point of the code receiving comparator is selected, to accurately receive commands sent by the host and improve the reliability and anti-interference of the system.

The circuit structure of the present disclosure can realize the intelligent constant current drive function, drive the light circuits with constant current in the voltage range of the whole bus, which does not depend on the parameters of the LEDs, the brightness of the LEDs is kept uniform, and the number of the LEDs can be flexibly adjusted. The high energy efficiency (more than 90%) is ensured. The specific implementation principle is as follows: the voltage division value of the voltage VH is obtained through the resistor divider module, the corresponding AD value is obtained through the analog-to-digital conversion module. The CPU module obtains the voltage of the bus corresponding to the current slave through the detected AD value, according to the basic principle of the drive module, the peak current value of the drive module is controlled by the signal ICTRL to achieve the compensation, thereby realizing the constant current characteristic of the lights in the voltage range of the whole wide bus. At the same time, under the BUCK drive structure, the constant current characteristics of the light circuits do not depend on the parameters of the LEDs, and the brightness of the LEDs is kept uniform, and the number of the LEDs can be flexibly adjusted, which can ensure high energy efficiency, e.g., basically reach more than 90%.

The circuit structure of the present disclosure can realize the intelligent fault detection function, realize the open and short circuit detection of each light circuit, and report the results to the host through bus communication, and the host can locate and repair in time according to the fault situation. The specific implementation principle is as follows: the resistor divider module obtains the voltage division values of the voltage VH, the voltage VD1, the voltage VD2, and the voltage VD3 respectively through time-division multiplexing, and then obtains the corresponding AD value through the analog-to-digital conversion module. The central processing unit calculates and judges the voltage drop value of the current light through the detected AD value, thereby determining whether the open circuit and the short circuit of the fault conditions occur in each group of lights and reports the results to the host through the bus communication.

The circuit structure of the present disclosure can intelligently control each light circuit. The central processing unit receives the instructions of the host through bus communication, and controls on and off of each BUCK driver through the signal MCTRL, to control the state of the light circuits by the host, for example, in a fire and emergency evacuation, each emergency evacuation light is lit or extinguished or flashed according to the instructions of the host, thus guiding the best escape route.

Figure 4:
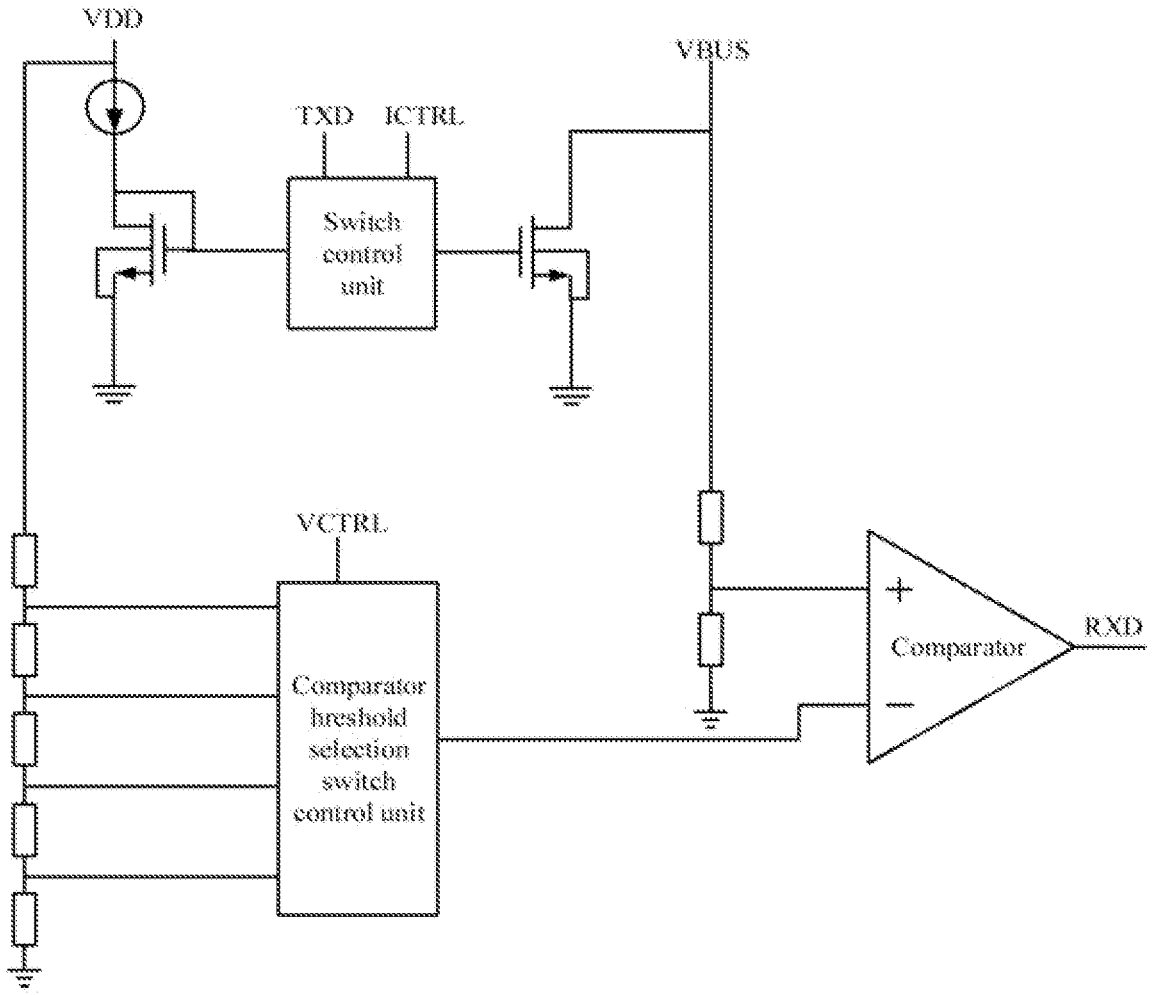
FIG. 4 is a schematic circuit diagram of a communication module of a monolithic bus slave circuit structure according to an embodiment of the present disclosure.
Figure 5:
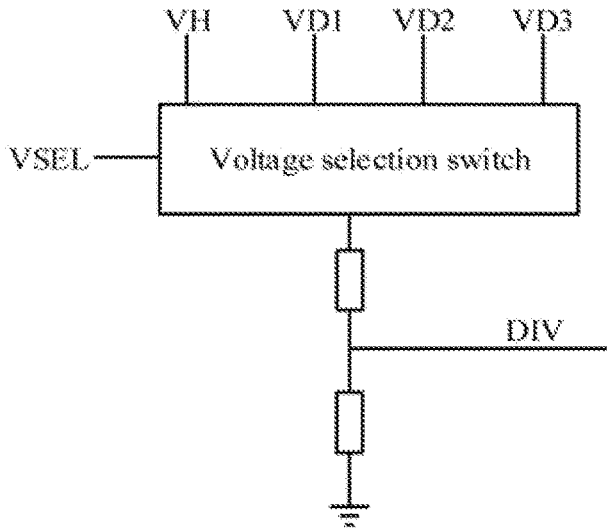
FIG. 5 is a schematic circuit diagram of a resistor divider module of a monolithic bus slave circuit structure according to an embodiment of the present disclosure.
Figure 6:
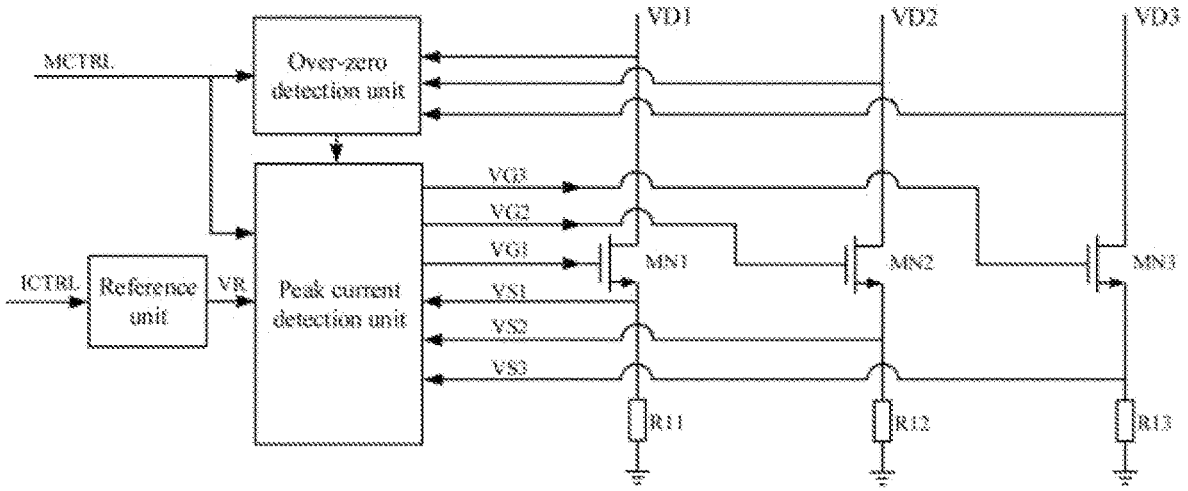
FIG. 6 is a schematic circuit diagram of a drive module of a monolithic bus slave circuit structure according to an embodiment of the present disclosure.

In an embodiment, an implementation manner of the communication module is shown in FIG. 4, an implementation manner of the resistor divider module is shown in FIG. 5, and an implementation manner of the drive module is shown in FIG. 6.

The communication module shown in FIG. 4 includes the switch control unit, the comparator threshold selection switch control unit and the comparator. The switch control unit is connected to the power supply voltage end and the bus voltage end respectively. The power supply voltage end is grounded through multiple resistors connected in series. Nodes between the multiple resistors are all connected to the comparator threshold selection switch control unit. The positive input end of the comparator is connected to the bus voltage end through the first resistor and is grounded through the second resistor. The negative input end of the comparator is connected to the comparator threshold selection switch control unit.

The resistor divider module shown in FIG. 5 includes the voltage selection switch. The voltage selection switch is connected to the first drive signal output pin, the second drive signal output pin, the third drive signal output pin and the power supply output pin. The input end of the voltage selection switch is connected to VSEL. The voltage selection switch is connected to the resistor divider circuit.

The drive module shown in FIG. 6 includes the over-zero detection unit, the peak current detection unit and the reference unit. The first drive signal output pin, the second drive signal output pin and the third drive signal output pin are connected to the input end of the over-zero detection unit. The input end of the peak current detection unit is connected to the output end of the over-zero detection unit and to the output end of the reference unit.

The drive module includes the first field effect transistor, the second field effect transistor and the third field effect transistor. The drain of the first field effect transistor is connected to the first drive signal output pin. The drain of the second field effect transistor is connected to the second drive signal output pin. The drain of the third field effect transistor is connected to the third drive signal output pin. Gates of the first field effect transistor, the second field effect transistor and the third field effect transistor are connected to the output end of the peak current detection unit. Sources of the first field effect transistor, the second field effect transistor and the third field effect transistor are grounded through resistors, and are connected to the input end of the peak current detection unit.

Figure 7:
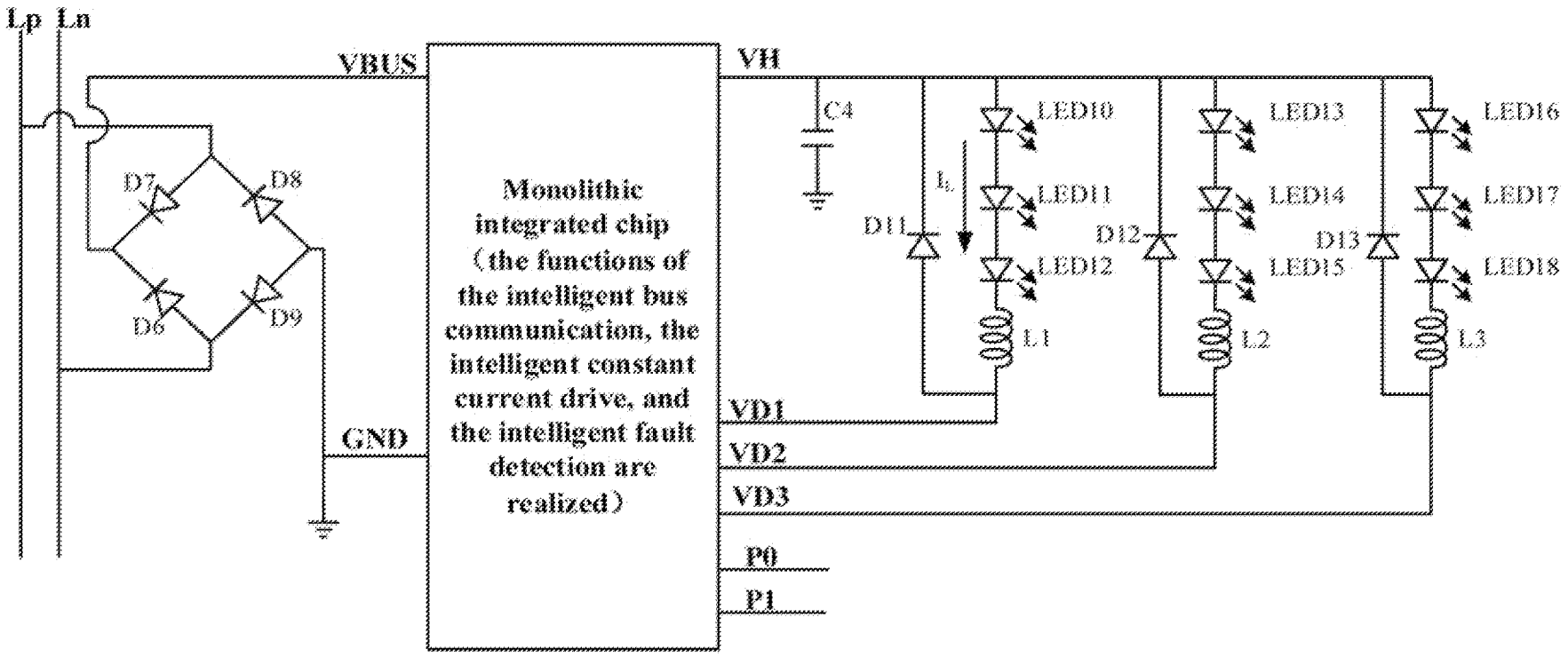
FIG. 7 is a schematic circuit diagram of a monolithic integrated chip of a monolithic bus slave circuit structure according to an embodiment of the present disclosure.

In other embodiments of the present disclosure, when three light circuits (the number of the light circuits can be reduced or increased as needed) are driven, the monolithic integrated chip includes six pins. In addition, two pins can be added to the monolithic integrated chip and the two pins are the first extension pin and the second extension pin. In an embodiment, the first extension pin is the P0 pin, and the second extension pin is the P1 pin, which are used to extend functions (they can be an IO port or an AD port, etc.), as shown in the FIG. 7, it can be implemented by using the cheapest SOP8 package, which greatly reduces the cost of the entire system.

Figure 8:
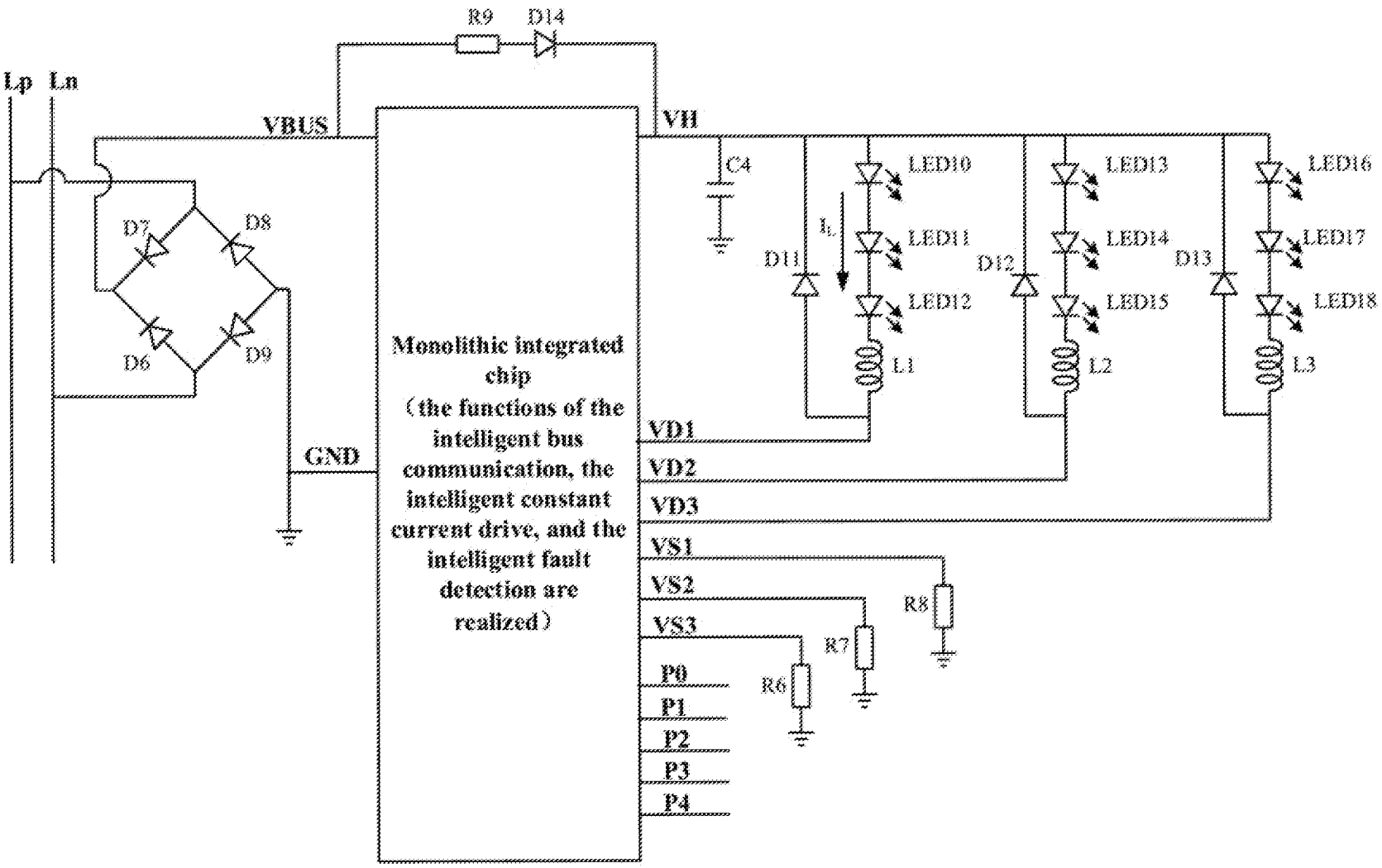
FIG. 8 is a schematic circuit diagram of a monolithic integrated chip of a monolithic bus slave circuit structure according to an embodiment of the present disclosure.

In other embodiments of the present disclosure, a current-limiting resistor R9 and an anti-backflow diode D14 can also be placed on the periphery of the monolithic integrated chip, and a resistor used to detect the peak current in the drive module can be placed on the periphery of the monolithic integrated chip. This can reduce the power of the chip and obtain more accurate constant current characteristics. As shown in FIG. 8, 5 pins used to extend the function applications (which can be an IO port or an AD port, etc.) are added, which can be implemented by using SOP14 package. Similarly, SOP16 package and SOP20 package can also be used to realize the technical solution of the monolithic integrated chip according to the required extended function data and the number of LEDs.

The present disclosure provides the monolithic bus slave circuit structure. The monolithic bus slave circuit structure can eliminate the complex design of using the DC/DC voltage conversion integrated chip in the prior art, and realize the intelligent constant current drive function, which greatly reduces the cost of the system. The implementation method provided by the present disclosure can adopt the cheapest SOP8 package to realize the emergency evacuation light slave circuit, and also adopt SOP14, SOP16, and SOP20 packages to realize the technical solution of the monolithic integrated chip according to the demand for extended functions and the number of lights.

When the circuit structure of the present disclosure drives the three light circuits, the monolithic integrated chip includes six pins, which are the bus voltage input pin, the power output pin, the ground pin, the first drive signal output pin, and the second drive signal output pin, and the third drive signal output pin. The specific implementation circuit is shown in FIG. 2, Lp is the positive line of the bus, and Ln is the negative line of the bus. The bus voltage VBUS is generated through the rectifier bridge including the diode D6, the diode D7, the diode D8, and the diode D9, and the bus voltage VBUS is connected to the monolithic integrated chip to act as the bus input. The power output pin of the monolithic integrated chip is connected to the energy storage capacitor C4, and the voltage VH is used as the power supply for driving the lights. The first drive signal output pin of the monolithic integrated chip is connected to one end of the first inductor L1 and the anode of the first freewheeling diode D11. The second drive signal output pin of the monolithic integrated chip is connected to one end of the second inductor L2 and the anode of the second freewheeling diode D12. The third drive signal output pin of the monolithic integrated chip is connected to one end of the third inductor L3 and the anode of the third freewheeling diode D13. The connection relationship of the three light circuits is as follows: the anode of the first diode LED10 in the first light circuit is connected to VH, the first diode LED10, the second diode LED11 and the third diode LED12 are connected in series in sequence, and the cathode of the third diode LED12 is connected to one end of the first inductor L1. The anode of the fourth diode LED13 in the second light circuit is connected to VH, the fourth diode LED13, the fifth diode LED14, and the sixth diode LED15 are connected in series in sequence, and the cathode of the sixth diode LED15 is connected to one end of the second inductor L2. The anode of the seventh diode LED16 in the third light circuit is connected to VH, the seventh diode LED16, the eighth diode LED17, and the ninth diode LED18 are connected in series in sequence, and the cathode of the ninth diode LED18 is connected to one end of the third inductor L3.

In an embodiment, the monolithic integrated chip includes the power conversion module, the communication module, the drive module, the central processing unit, the resistor divider module, the analog-to-digital conversion module, as shown in FIG. 3. The functions of intelligent bus communication, the intelligent constant current drive and the intelligent fault detection are realized by the monolithic integrated chip.

In the prior art, the high-cost DC/DC voltage conversion integrated chip is required, which leads to high cost of the system. The present disclosure provides the monolithic bus slave circuit structure. The monolithic bus slave circuit structure can eliminate the complex design of using the DC/DC voltage conversion integrated chip in the prior art, and realize the intelligent constant current drive function, which reduce the cost of the system. The implementation method provided by the present disclosure can adopt the cheapest SOP8 package to realize the emergency evacuation light slave circuit, and also adopt SOP14, SOP16, and SOP20 packages to realize the technical solution of the monolithic integrated chip according to the demand for extended functions and the number of lights.

In the prior art, the communication module is realized by a large number of discrete devices, and the communication threshold point is single, which are difficult to adapt to the voltage range of the whole bus. Therefore, the reliability and anti-interference characteristics are poor. In the present disclosure, the communication module is integrated inside of the monolithic integrated chip, which can realize the intelligent communication function of the bus and cover a wide voltage range of the bus. For the slave circuits hooked up at different positions of the bus, the comparison threshold point of the code receiving comparator can be adjusted intelligently, so that the number of the slaves hooked up on the bus can be increased. This reduces the total installation cost of the whole building and improves the reliability and anti-interference of the system.

The present disclosure can realize the intelligent constant current drive function, and drive the light circuits with the constant current in the voltage range of the whole bus, which does not depend on the parameters of the LEDs. The brightness of the LEDs is kept uniform, and the number of LEDs can be flexibly adjusted. The high energy efficiency is ensured.

The present disclosure can realize the intelligent fault detection function and the open and short circuit detection of each group of lights, and then the results are reported to the host through bus communication, and the host can locate and repair the fault in time according to the fault situation.

The monolithic bus slave circuit structure of the present disclosure can realize the intelligent constant current drive function, and drive the light circuits with the constant current in the voltage range of the whole bus, which does not depend on the parameters of the LEDs. The brightness of the LEDs is kept uniform, and the number of the LEDs can be flexibly adjusted. Finally, the high energy efficiency is ensured. The present disclosure can realize the intelligent fault detection function and the open and short circuit detection of each group of lights, and then the results are reported to the host through bus communication, and the host can locate and repair the fault in time according to the fault situation.

In this specification, the present disclosure has been described with reference to particular embodiments thereof. However, it is clear that various modifications and transformations can still be made without departing from the spirit and scope of the present disclosure. Accordingly, the specification and accompanying drawings should be considered as illustrative rather than limiting.

What is claimed is:

1. A monolithic bus slave circuit structure, comprising:

a monolithic integrated chip, wherein the monolithic integrated chip includes a bus voltage input pin, a ground pin, a first drive signal output pin, a second drive signal output pin, a third drive signal output pin, and a power output pin;

a rectifier bridge, wherein both the bus voltage input pin and the ground pin are connected to an output end of the rectifier bridge, two input ends of the rectifier bridge are connected to a positive line and an negative line of a bus respectively, wherein the ground pin is grounded;

a first light circuit, connected between the first drive signal output pin and the power output pin;

a second light circuit, connected between the second drive signal output pin and the power output pin; and a third light circuit, connected between the third drive signal output pin and the power output pin;

wherein the power output pin is connected to one end of an energy storage capacitor, and the other end of the energy storage capacitor is grounded.

2. The monolithic bus slave circuit structure according to claim 1, wherein the first light circuit comprises a first inductor, a first diode string and a first freewheeling diode, wherein the first inductor is connected between the first drive signal output pin and one end of the first diode string, the other end of the first diode string is connected to the power output pin, an anode of the first freewheeling diode is connected to the first drive signal output pin, a cathode of the first freewheeling diode is connected to the power output pin;

the second light circuit comprises a second inductor, a second diode string and a second freewheeling diode, wherein the second inductor is connected between the second drive signal output pin and one end of the second diode string, the other end of the second diode string is connected to the power output pin, an anode of the second freewheeling diode is connected to the second drive signal output pin, a cathode of the second freewheeling diode is connected to the power output pin;

the third light circuit comprises a third inductor, a third diode string and a third freewheeling diode, wherein the third inductor is connected between the third drive signal output pin and one end of the third diode string, the other end of the third diode string is connected to the power output pin, an anode of the third freewheeling diode is connected to the third drive signal output pin, a cathode of the third freewheeling diode is connected to the power output pin.

3. The monolithic bus slave circuit structure according to claim 2, wherein the first diode string comprises a first diode, a second diode, and a third diode connected in series, the second diode string comprises a fourth diode, a fifth diode, and a sixth diode connected in series, the third diode string comprises a seventh diode, an eighth diode, and a ninth diode connected in series.

4. The monolithic bus slave circuit structure according to claim 1, wherein the monolithic integrated chip comprises:

a power conversion module, connected to a central processing unit, a communication module, an analog-to-digital conversion module, a resistor divider module and a drive module, for generating internal power supply and providing power to the central processing unit, the communication module, the analog-to-digital conversion module, the resistor divider module and the drive module;

the central processing unit, connected to the communication module, the analog-to-digital conversion module, the resistor divider module and the drive module, for controlling signal transmission between a host and slaves;

the communication module, connected to the bus voltage input pin, for transmitting signals between the host and the slaves;

the analog-to-digital conversion module, connected to the resistor divider module, for converting an analog signal to a digital signal;

the resistor divider module, connected to the first drive signal output pin, the second drive signal output pin, and the third drive signal output pin, for obtaining resistance division voltage values;

the drive module, connected to the first drive signal output pin, the second drive signal output pin, and the third drive signal output pin, for driving the first light circuit, the second light circuit, and the third light circuit.

5. The monolithic bus slave circuit structure according to claim 4, wherein the communication module comprises a switch control unit, a comparator threshold selection switch control unit and a comparator, wherein the switch control unit is connected to a power supply voltage end and a bus voltage end respectively, wherein the power supply voltage end is grounded through a plurality of resistors connected in series, nodes between the plurality of resistors are all connected to the comparator threshold selection switch control unit, and the comparator threshold selection switch control unit is also connected to an inverting input end of the comparator, a non-inverting input end of the comparator is connected to the bus voltage end through a resistor, and the non-inverting input end of the comparator is also grounded through a second resistor.

6. The monolithic bus slave circuit structure according to claim 4, wherein the drive module comprises an over-zero detection unit, a peak current detection unit and a reference unit; wherein the first drive signal output pin, the second drive signal output pin and the third drive signal output pin are connected to an input end of the over-zero detection unit, an input end of the peak current detection unit is connected to an output end of the over-zero detection unit and an output end of the reference unit;

the drive module comprises a first field effect transistor, a second field effect transistor and a third field effect transistor, a drain of the first field effect transistor is connected to the first drive signal output pin, a drain of the second field effect transistor is connected to the second drive signal output pin, and a drain of the third field effect transistor is connected to the third drive signal output pin, gates of the first field effect transistor, the second field effect transistor and the third field effect transistor are connected to an output end of the peak current detection unit, sources of the first field effect transistor, the second field effect transistor and the third field effect transistor are grounded through resistors respectively, and are connected to the input end of the peak current detection unit.

7. The monolithic bus slave circuit structure according to claim 4, wherein the communication module is connected to the central processing unit through a first line, a second line and a third line, wherein the first line is for outputting a decoded signal to realize the control and instruction operation of the host to the slaves; the second line is for sending signals to the host according to the situation of intelligent drive and intelligent fault detection; the third line is for outputting a control signal to the communication module, to intelligently adjust a comparison threshold point of a code receiving comparator of the communication module.

8. The monolithic bus slave circuit structure according to claim 4, wherein the drive module connected to the central processing unit through a fourth line and a fifth line, the central processing unit controls a constant current value of the drive module through the fourth line, and controls on and off of the drive module through the fifth line.

9. The monolithic bus slave circuit structure according to claim 4, wherein the communication module transmits signals between the host and the slaves by sampling and decoding a voltage waveform of a bus voltage and extracting current from the bus voltage input pin.

10. The monolithic bus slave circuit structure according to claim 4, wherein the resistance division voltage values are voltage division values of the bus voltage input pin, the ground pin, the first drive signal output pin, the second drive signal output pin, the third drive signal output pin, and the power supply output pin.

11. The monolithic bus slave circuit structure according to claim 1, wherein the monolithic integrated chip further includes a first extension pin and a second extension pin.

* * * * *